US010192489B1

(12) United States Patent
Liu

(10) Patent No.: US 10,192,489 B1
(45) Date of Patent: Jan. 29, 2019

(54) PIXEL COMPENSATION CIRCUIT AND DISPLAY DEVICE

(71) Applicant: WUHAN CHINA STAR OPTOELECTRONICS SEMICONDUCTOR DISPLAY TECHNOLOGY CO., LTD., Wuhan, Hubei (CN)

(72) Inventor: Jie Liu, Wuhan (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 15/577,179

(22) PCT Filed: Sep. 6, 2017

(86) PCT No.: PCT/CN2017/100703

§ 371 (c)(1),
(2) Date: Nov. 27, 2017

(30) Foreign Application Priority Data

Jul. 25, 2017 (CN) ..... 2017 1 0613403

(51) Int. Cl.
*G09G 3/3258* (2016.01)

(52) U.S. Cl.
CPC ... *G09G 3/3258* (2013.01); *G09G 2300/0819* (2013.01); *G09G 2320/0204* (2013.01); *G09G 2320/0233* (2013.01); *G09G 2320/045* (2013.01)

(58) Field of Classification Search
CPC ..... G09G 3/3258; G09G 2300/0819; G09G 2320/0204; G09G 2320/0233; G09G 2320/045
See application file for complete search history.

(56) References Cited

U.S. PATENT DOCUMENTS

| | | | | |
|---|---|---|---|---|
| 8,963,907 | B2 * | 2/2015 | Tsai | G09G 3/14 345/212 |
| 8,982,017 | B2 * | 3/2015 | Lee | G09G 3/3225 345/76 |
| 9,953,571 | B2 * | 4/2018 | Hu | G09G 3/32 |
| 2013/0057532 | A1 * | 3/2013 | Lee | G09G 3/3225 345/211 |
| 2013/0127818 | A1 * | 5/2013 | Tsai | G09G 3/14 345/212 |
| 2017/0069263 | A1 * | 3/2017 | Hu | G09G 3/32 |
| 2017/0256202 | A1 * | 9/2017 | Sun | G09G 3/32 |
| 2017/0365215 | A1 * | 12/2017 | He | G09G 3/20 |

FOREIGN PATENT DOCUMENTS

| | | | |
|---|---|---|---|
| CN | 104835453 | A | 8/2015 |
| CN | 105845081 | A | 8/2016 |
| CN | 106486063 | A | 3/2017 |
| CN | 106652903 | A | 5/2017 |

* cited by examiner

*Primary Examiner* — Peter D McLoone
(74) *Attorney, Agent, or Firm* — Kirton McConkie; Evan R. Witt

(57) ABSTRACT

A pixel compensation circuit and a display device are provided. The pixel compensation circuit includes a light emitting device, a driving module, a reset module, a reference voltage writing module, a data voltage writing module, a power voltage writing module, and a light emitting control module.

19 Claims, 2 Drawing Sheets

PIXEL COMPENSATION CIRCUIT AND DISPLAY DEVICE

BACKGROUND

Field

The present disclosure relates to a technological field of displays, and more particularly to a pixel compensation circuit and a display device.

Background

An organic light emitting diode (OLED) display device has a wide color gamut and a high contrast ratio, and it can save energy and be foldable. Accordingly, OLED display devices have strong competitiveness when compared with existing display devices in the prior art. However, since the luminance of an OLED is relevant to a current flowing through the OLED, electrical performance of a driving transistor directly affects the display effect. More particularly, a threshold voltage of the driving transistor is often drifting, so that the problem that brightness of the OLED display device is not uniform occurs.

Generally, to improve the display effect of an OLED display device, pixel compensation by a driving circuit is required for the OLED display device. FIG. 1 illustrates a conventional pixel compensation circuit. As shown in FIG. 1, the circuit includes four transistors T0, T1, T2, and T3 and a storage capacitor Cst. A driving process of the circuit includes a reset stage, a threshold voltage acquisition stage, and a light emitting stage. However, a problem that an OLED emits light too early exists in the circuit. That is, when the circuit is in the reset stage, the OLED starts to emit light. A data voltage Vdata is not written completely, and a threshold voltage is not acquired completely. The brightness of the OLED is not uniform, and compensation is not complete, so that an image is poor. Further, when a power line connected to pixels is longer, a power voltage Vdd has a larger voltage drop (IR Drop), so that the brightness of the OLED display device is not uniform.

Consequently, there is a need to provide a pixel compensation circuit and a display device to solve the above-mentioned problems in the prior art.

SUMMARY OF THE DISCLOSURE

An objective of the present disclosure is to provide a pixel compensation circuit and a display device which can compensate for a threshold voltage and a voltage drop of a power voltage and solve the problem that a light emitting device emits light too early.

A pixel compensation circuit provided by the present disclosure includes a light emitting device, a driving module, a reset module, a reference voltage writing module, a data voltage writing module, a power voltage writing module, and a light emitting control module, A control terminal of the reset module is electrically coupled to a reset signal control terminal, an input terminal of the reset module is electrically coupled to a first node, an output terminal of the reset module is electrically coupled to a ground, and the reset module is configured to reset the first node;

A control terminal of the reference voltage writing module is electrically coupled to a first control signal terminal, an input terminal of the reference voltage writing module is electrically coupled to a reference voltage terminal, an output terminal of the reference voltage writing module is electrically coupled to a second node, and the reference voltage writing module is configured to reset the second node and to write a reference voltage outputted by the reference voltage terminal to the second node;

A control terminal of the data voltage writing module is electrically coupled to a second control signal terminal, an input terminal of the data voltage writing module is electrically coupled to a data voltage terminal, an output terminal of the data voltage writing module is electrically coupled to the first node, and the data voltage writing module is configured to write a difference value between a data voltage outputted by the data voltage terminal and a threshold voltage to the first node;

A control terminal of the power voltage writing module is electrically coupled to a third control signal terminal, an input terminal of the power voltage writing module is electrically coupled to a power voltage terminal, an output terminal of the power voltage writing module is electrically coupled to the second node, and the power voltage writing module is configured to write a power voltage outputted by the power voltage terminal to the second node;

A control terminal of the light emitting control module is electrically coupled to a third control signal terminal, an input terminal of the light emitting control module is electrically coupled to an output of the driving module, an output terminal of the light emitting control module is electrically coupled to an anode of the light emitting device, and the light emitting control module is configured to control the driving module to drive the light emitting device to emit light;

A first terminal of the driving module is electrically coupled to the first node, and a second terminal of the driving module is electrically coupled to the second node;

A cathode of the light emitting device is electrically coupled to the ground;

The driving module includes a driving transistor and a storage capacitor, the other terminal of the capacitor is electrically coupled to a ground;

A gate of the driving transistor is electrically coupled to the first node, a source of the driving transistor is electrically coupled to the second node, and a drain of the driving transistor is electrically coupled to the input terminal of the light emitting control module;

The storage capacitor is electrically coupled between the first node and the second node;

The reset module includes a first transistor,

A gate of the first transistor is electrically coupled to the reset signal control terminal, a source of the first transistor is electrically coupled to the first node, and a drain of the first transistor is electrically coupled to the ground.

In the pixel compensation circuit of the present disclosure, the reference voltage writing module includes a second transistor, A gate of the second transistor is electrically coupled to the first control signal terminal, a source of the second transistor is electrically coupled to the reference voltage terminal, and a drain of the second transistor is electrically coupled to the second node.

In the pixel compensation circuit of the present disclosure, the data voltage writing module includes a third transistor and a fourth transistor, A gate of the third transistor is electrically coupled to the second control signal terminal, a source of the third transistor is electrically coupled to the data voltage terminal, and a drain of the third transistor is electrically coupled to a source of the fourth transistor;

A gate and a drain of the fourth transistor are electrically coupled to the first node.

In the pixel compensation circuit of the present disclosure, the power voltage writing module includes a fifth transistor, A gate of the fifth transistor is electrically coupled to the third control signal terminal, a source of the fifth transistor is electrically coupled to the power voltage terminal, and a drain of the fifth transistor is electrically coupled to the second node.

In the pixel compensation circuit of the present disclosure, the light emitting control module includes a sixth transistor, A gate of the sixth transistor is electrically coupled to the third control signal terminal, a source of the sixth transistor is electrically coupled to the output terminal of the driving module, and a drain of the sixth transistor is electrically coupled to the anode of the light emitting device.

The present disclosure further provides a pixel compensation circuit, including a light emitting device, a driving module, a reset module, a reference voltage writing module, a data voltage writing module, a power voltage writing module, and a light emitting control module, A control terminal of the reset module is electrically coupled to a reset signal control terminal, an input terminal of the reset module is electrically coupled to a first node, an output terminal of the reset module is electrically coupled to a ground, and the reset module is configured to reset the first node;

A control terminal of the reference voltage writing module is electrically coupled to a first control signal terminal, an input terminal of the reference voltage writing module is electrically coupled to a reference voltage terminal, an output terminal of the reference voltage writing module is electrically coupled to a second node, and the reference voltage writing module is configured to reset the second node and to write a reference voltage outputted by the reference voltage terminal to the second node;

A control terminal of the data voltage writing module is electrically coupled to a second control signal terminal, an input terminal of the data voltage writing module is electrically coupled to a data voltage terminal, an output terminal of the data voltage writing module is electrically coupled to the first node, and the data voltage writing module is configured to write a difference value between a data voltage outputted by the data voltage terminal and a threshold voltage to the first node;

A control terminal of the power voltage writing module is electrically coupled to a third control signal terminal, an input terminal of the power voltage writing module is electrically coupled to a power voltage terminal, an output terminal of the power voltage writing module is electrically coupled to the second node, and the power voltage writing module is configured to write a power voltage outputted by the power voltage terminal to the second node;

A control terminal of the light emitting control module is electrically coupled to a third control signal terminal, an input terminal of the light emitting control module is electrically coupled to an output of the driving module, an output terminal of the light emitting control module is electrically coupled to an anode of the light emitting device, and the light emitting control module is configured to control the driving module to drive the light emitting device to emit light;

A first terminal of the driving module is electrically coupled to the first node, and a second terminal of the driving module is electrically coupled to the second node;

A cathode of the light emitting device is electrically coupled to the ground.

In the pixel compensation circuit of the present disclosure, the driving module includes a driving transistor and a storage capacitor, A gate of the driving transistor is electrically coupled to the first node, a source of the driving transistor is electrically coupled to the second node, and a drain of the driving transistor is electrically coupled to the input terminal of the light emitting control module;

The storage capacitor is electrically coupled between the first node and the second node.

In the pixel compensation circuit of the present disclosure, the reset module includes a first transistor, A gate of the first transistor is electrically coupled to the reset signal control terminal, a source of the first transistor is electrically coupled to the first node, and a drain of the first transistor is electrically coupled to the ground.

In the pixel compensation circuit of the present disclosure, the reference voltage writing module includes a second transistor, A gate of the second transistor is electrically coupled to the first control signal terminal, a source of the second transistor is electrically coupled to the reference voltage terminal, and a drain of the second transistor is electrically coupled to the second node.

In the pixel compensation circuit of the present disclosure, the data voltage writing module includes a third transistor and a fourth transistor, A gate of the third transistor is electrically coupled to the second control signal terminal, a source of the third transistor is electrically coupled to the data voltage terminal, and a drain of the third transistor is electrically coupled to a source of the fourth transistor;

A gate and a drain of the fourth transistor are electrically coupled to the first node.

In the pixel compensation circuit of the present disclosure, the power voltage writing module includes a fifth transistor, A gate of the fifth transistor is electrically coupled to the third control signal terminal, a source of the fifth transistor is electrically coupled to the power voltage terminal, and a drain of the fifth transistor is electrically coupled to the second node.

In the pixel compensation circuit of the present disclosure, the light emitting control module includes a sixth transistor, A gate of the sixth transistor is electrically coupled to the third control signal terminal, a source of the sixth transistor is electrically coupled to the output terminal of the driving module, and a drain of the sixth transistor is electrically coupled to the anode of the light emitting device.

A display device is further provided in accordance with the above-mentioned objective. The display device includes a pixel compensation circuit. The pixel compensation circuit includes a light emitting device, a driving module, a reset module, a reference voltage writing module, a data voltage writing module, a power voltage writing module, and a light emitting control module, A control terminal of the reset module is electrically coupled to a reset signal control terminal, an input terminal of the reset module is electrically coupled to a first node, an output terminal of the reset module is electrically coupled to a ground, and the reset module is configured to reset the first node;

A control terminal of the reference voltage writing module is electrically coupled to a first control signal terminal, an input terminal of the reference voltage writing module is electrically coupled to a reference voltage terminal, an output terminal of the reference voltage writing module is electrically coupled to a second node, and the reference voltage writing module is configured to reset the second node and to write a reference voltage outputted by the reference voltage terminal to the second node;

A control terminal of the data voltage writing module is electrically coupled to a second control signal terminal, an input terminal of the data voltage writing module is electrically coupled to a data voltage terminal, an output terminal of the data voltage writing module is electrically coupled to the first node, and the data voltage writing module is configured to write a difference value between a data voltage outputted by the data voltage terminal and a threshold voltage to the first node;

A control terminal of the power voltage writing module is electrically coupled to a third control signal terminal, an input terminal of the power voltage writing module is electrically coupled to a power voltage terminal, an output terminal of the power voltage writing module is electrically coupled to the second node, and the power voltage writing module is configured to write a power voltage outputted by the power voltage terminal to the second node;

A control terminal of the light emitting control module is electrically coupled to a third control signal terminal, an input terminal of the light emitting control module is electrically coupled to an output of the driving module, an output terminal of the light emitting control module is electrically coupled to an anode of the light emitting device, and the light emitting control module is configured to control the driving module to drive the light emitting device to emit light;

A first terminal of the driving module is electrically coupled to the first node, and a second terminal of the driving module is electrically coupled to the second node;

A cathode of the light emitting device is electrically coupled to the ground.

In the display device of the present disclosure, the driving module comprises a driving transistor and a storage capacitor, A gate of the driving transistor is electrically coupled to the first node, a source of the driving transistor is electrically coupled to the second node, and a drain of the driving transistor is electrically coupled to the input terminal of the light emitting control module;

The storage capacitor is electrically coupled between the first node and the second node.

In the display device of the present disclosure, the reset module comprises a first transistor, A gate of the first transistor is electrically coupled to the reset signal control terminal, a source of the first transistor is electrically coupled to the first node, and a drain of the first transistor is electrically coupled to the ground.

In the display device of the present disclosure, the reference voltage writing module comprises a second transistor, A gate of the second transistor is electrically coupled to the first control signal terminal, a source of the second transistor is electrically coupled to the reference voltage terminal, and a drain of the second transistor is electrically coupled to the second node.

In the display device of the present disclosure, the data voltage writing module comprises a third transistor and a fourth transistor, A gate of the third transistor is electrically coupled to the second control signal terminal, a source of the third transistor is electrically coupled to the data voltage terminal, and a drain of the third transistor is electrically coupled to a source of the fourth transistor;

A gate and a drain of the fourth transistor are electrically coupled to the first node.

In the display device of the present disclosure, the power voltage writing module comprises a fifth transistor, A gate of the fifth transistor is electrically coupled to the third control signal terminal, a source of the fifth transistor is electrically coupled to the power voltage terminal, and a drain of the fifth transistor is electrically coupled to the second node.

In the display device of the present disclosure, the light emitting control module comprises a sixth transistor, A gate of the sixth transistor is electrically coupled to the third control signal terminal, a source of the sixth transistor is electrically coupled to the output terminal of the driving module, and a drain of the sixth transistor is electrically coupled to the anode of the light emitting device.

In the pixel compensation circuit and the display device in accordance with the present disclosure, the light emitting control module controls the light emitting device to emit light, and the reference voltage writing module compensates for the voltage drop of power voltage. As such, the pixel compensation circuit can compensate for the threshold voltage and the voltage drop of the power voltage and solve the problem that the light emitting device emits light too early, thereby delaying deterioration of the light emitting device and increasing a contrast ration of a display image.

For better understanding of the aforementioned content of the present disclosure, preferable embodiments are illustrated in accordance with the attached drawings for further explanation.

BRIEF DESCRIPTION OF THE DRAWINGS

The technical solutions, as well as beneficial advantages, of the present disclosure will be apparent from the following detailed description of embodiments of the present disclosure, with reference to the attached drawings.

DETAILED DESCRIPTION OF THE PREFERRED EMBODIMENTS

To describe the technical solutions and effect of the present disclosure more clearly, a clear and complete description will be given below, in conjunction with the accompanying drawings in the embodiments of the present disclosure. Apparently, the embodiments described below are merely a part, but not all, of the embodiments of the present disclosure. All of other embodiments, obtained by those skilled in the art based on the embodiments of the present disclosure without any inventive efforts, fall into the protection scope of the present disclosure.

Figure 1:
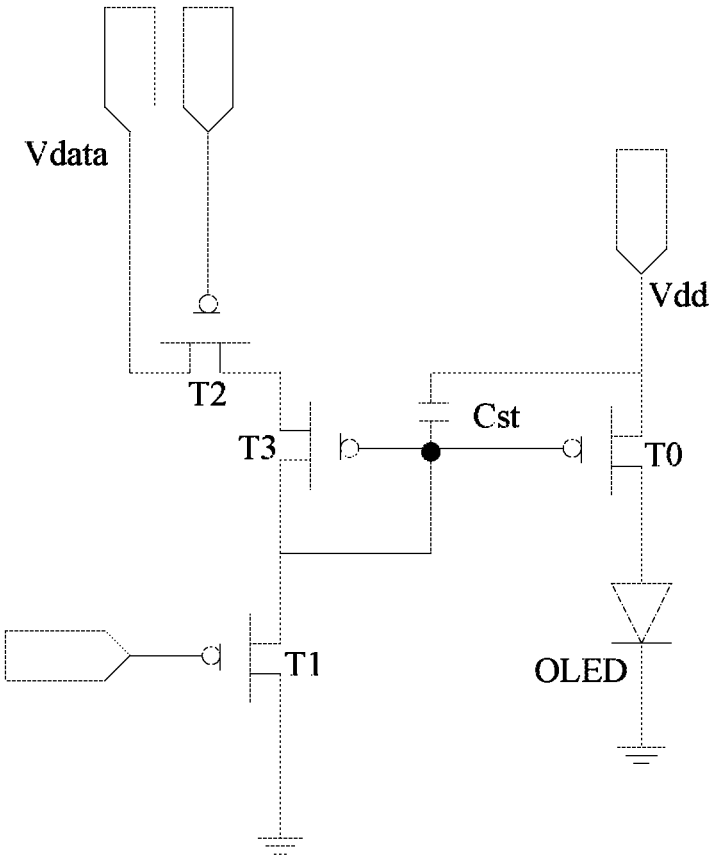
FIG. 1 (PRIOR ART)
FIG. 1 illustrates a conventional pixel compensation circuit.
Figure 2:
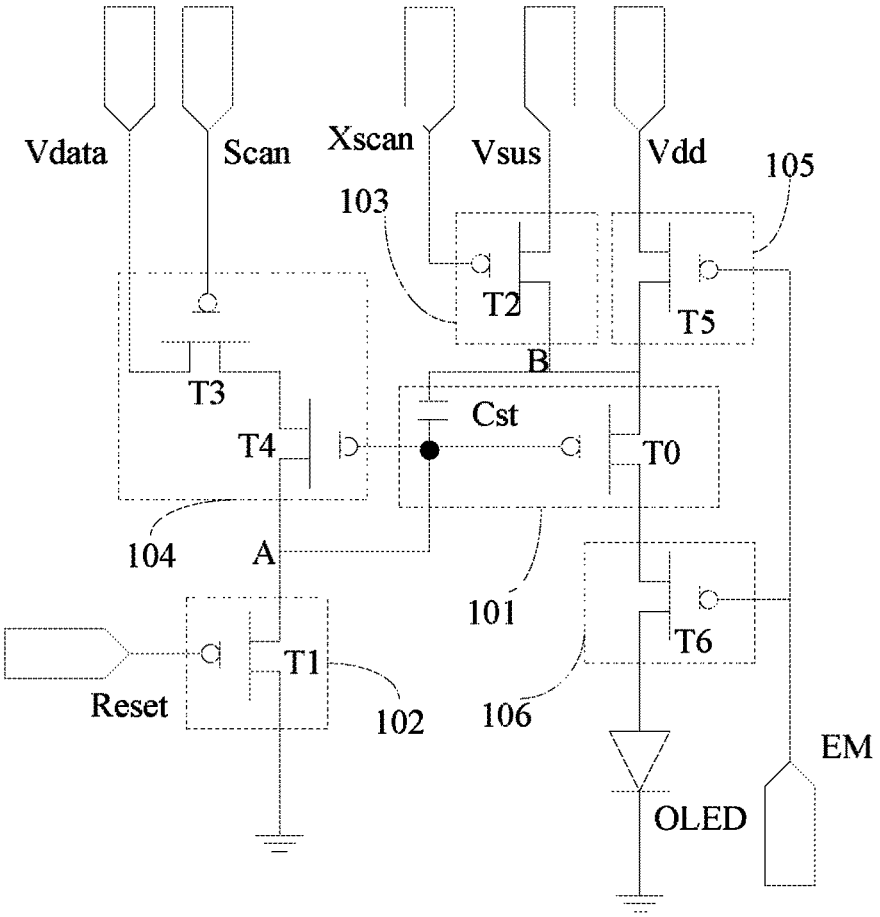
FIG. 2 illustrates a pixel compensation circuit provided by a preferred embodiment of the present disclosure.

Please refer to FIG. 2. FIG. 2 illustrates a pixel compensation circuit provided by a preferred embodiment of the present disclosure. As shown in FIG. 2, the pixel compensation circuit in accordance with the preferred embodiment of the present disclosure includes a light emitting device OLED, a driving module 101, a reset module 102, a reference voltage writing module 103, a data voltage writing module 104, a power voltage writing module 105, and a light emitting control module 106.

It is noted that a reset signal control terminal is configured to output a reset signal Reset. A first control signal terminal is configured to output a first control signal Xscan. A second control signal terminal is configured to output a second control signal Scan. A third control signal terminal is configured to output a third control signal EM. A data voltage terminal is configured to output a data voltage Vdata. A reference voltage terminal is configured to output a reference voltage Vsus. A power voltage terminal is configured to output a power voltage Vdd.

A control terminal of the reset module 102 is electrically coupled to the reset signal control terminal. An input terminal of the reset module 102 is electrically coupled to a first node A. An output terminal of the reset module 102 is electrically coupled to a ground. The reset module 102 is configured to reset the first node A.

A control terminal of the reference voltage writing module 103 is electrically coupled to the first control signal terminal. An input terminal of the reference voltage writing module 103 is electrically coupled to the reference voltage terminal. An output terminal of the reference voltage writing module 103 is electrically coupled to a second node B. The reference voltage writing module 103 is configured to reset the second node B and to write the reference voltage Vsus outputted by the reference voltage terminal to the second node B.

A control terminal of the data voltage writing module 104 is electrically coupled to the second control signal terminal. An input terminal of the data voltage writing module 104 is electrically coupled to the data voltage terminal. An output terminal of the data voltage writing module 104 is electrically coupled to the first node A. The data voltage writing module 104 is configured to write a difference value between the data voltage Vdata outputted by the data voltage terminal and a threshold voltage to the first node A.

A control terminal of the power voltage writing module 105 is electrically coupled to the third control signal terminal. An input terminal of the power voltage writing module 105 is electrically coupled to the power voltage terminal. An output terminal of the power voltage writing module 105 is electrically coupled to the second node B. The power voltage writing module 105 is configured to write the power voltage Vdd outputted by the power voltage terminal to the second node B.

A control terminal of the light emitting control module 106 is electrically coupled to the third control signal terminal. An input terminal of the light emitting control module 106 is electrically coupled to an output of the driving module 101. An output terminal of the light emitting control module 106 is electrically coupled to an anode of the light emitting device OLED. The light emitting control module 106 is configured to control the driving module 101 to drive the light emitting device OLED to emit light.

A first terminal of the driving module 101 is electrically coupled to the first node A. A second terminal of the driving module 101 is electrically coupled to the second node B. A cathode of the light emitting device OLED is electrically coupled to the ground.

In detail, the driving module 101 includes a driving transistor T0 and a storage capacitor Cst. A gate of the driving transistor T0 is electrically coupled to the first node A. A source of the driving transistor T0 is electrically coupled to the second node B. A drain of the driving transistor T0 is electrically coupled to the input terminal of the light emitting control module 106. The storage capacitor Cst is electrically coupled between the first node A and the second node B.

The reset module 102 includes a first transistor T1. A gate of the first transistor T1 is electrically coupled to the reset signal control terminal. A source of the first transistor T1 is electrically coupled to the first node A. A drain of the first transistor T1 is electrically coupled to the ground.

The reference voltage writing module 103 includes a second transistor T2. A gate of the second transistor T2 is electrically coupled to the first control signal terminal. A source of the second transistor T2 is electrically coupled to the reference voltage terminal. A drain of the second transistor T2 is electrically coupled to the second node B.

The data voltage writing module 104 includes a third transistor T3 and a fourth transistor T4. A gate of the third transistor T3 is electrically coupled to the second control signal terminal. A source of the third transistor T3 is electrically coupled to the data voltage terminal. A drain of the third transistor T3 is electrically coupled to a source of the fourth transistor T4. A gate and a drain of the fourth transistor T4 are electrically coupled to the first node A.

The power voltage writing module 105 includes a fifth transistor T5. A gate of the fifth transistor T5 is electrically coupled to the third control signal terminal. A source of the fifth transistor T5 is electrically coupled to the power voltage terminal. A drain of the fifth transistor T5 is electrically coupled to the second node B.

The light emitting control module 106 includes a sixth transistor T6. A gate of the sixth transistor T6 is electrically coupled to the third control signal terminal. A source of the sixth transistor T6 is electrically coupled to the output terminal of the driving module 101. A drain of the sixth transistor T6 is electrically coupled to the anode of the light emitting device OLED.

It is noted that the first transistor T1, the second transistor T2, the third transistor T3, the fourth transistor T4, the fifth transistor T5, the sixth transistor T6, and the driving transistor T0 in the present preferred embodiment are P-type transistors.

Figure 3:
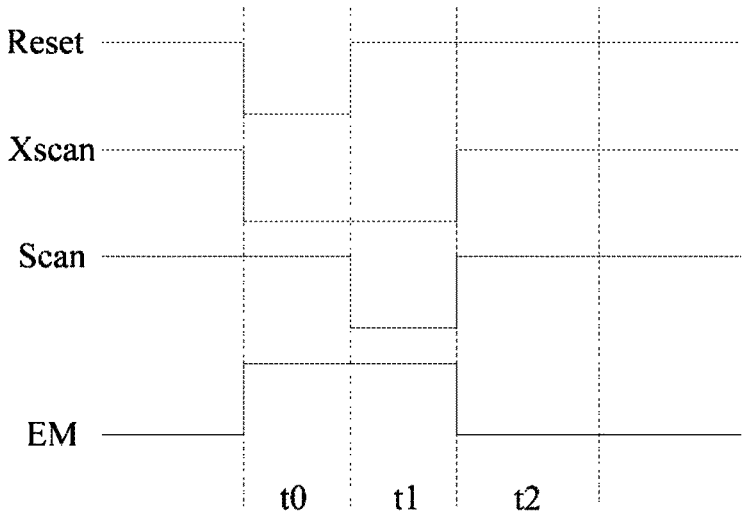
FIG. 3 illustrates a timing diagram of the pixel compensation circuit provided by a preferred embodiment of the present disclosure.

A process of driving the light emitting device OLED by the pixel compensation circuit in FIG. 2 will be described in conjunction with FIG. 3 in detail as follows. FIG. 3 illustrates a timing diagram of the pixel compensation circuit provided by a preferred embodiment of the present disclosure. As shown in FIG. 3, a working timing diagram may include three stages: a reset stage t0, a compensation stage t1, and a light emitting stage t2.

In the reset stage t0, the pixel compensation circuit resets the first node A and the second node B. In detail, in the reset stage t0, the reset signal Reset outputted by the reset signal control terminal is at a low level, and the first control signal Xscan outputted by the first control signal terminal is at a low level, so that the first transistor T1 and the second transistor T2 are turned on. The reference voltage Vsus outputted by the reference voltage terminal passes the second transistor T2, the storage capacitor Cst, and the first transistor T1 and reaches the ground, so that a ground circuit is formed to discharge the storage capacitor Cst. As such, voltage levels of the first node A and the second node B are pulled down. It is noted that the third control signal EM outputted by the third control signal terminal is at a high level, so that the fifth transistor T5 and the sixth transistor T6 are cut off. Accordingly, a situation that the driving transistor T0 is turned on because of the low level at the first node A can be avoided, thereby preventing the light emitting device OLED from emitting light in the reset stage t0.

In the compensation stage t1, the second control signal Scan outputted by the reset signal control terminal is at a low level, and the first control signal Xscan outputted by the second control signal terminal is still at a low level. Further, the gate and the drain of the fourth transistor T4 are short circuited in the pixel compensation circuit, and the threshold voltage of the fourth transistor T4 can be acquired at this time. The second transistor T2 and the third transistor T3 are turned on. The difference value between the data voltage Vdata outputted by the data voltage terminal and the threshold voltage of the fourth transistor T4 is transmitted to the first node A, so that the voltage level of the first node A is Vdata-Vth. The reference voltage Vsus outputted by the reference voltage terminal is transmitted by the second node B, so that the voltage level of the second node B is Vsus. It is noted that the third control signal EM outputted by the third control signal terminal is at a high level, so that the fifth transistor T5 and the sixth transistor T6 are cut off. Accordingly, a situation that the driving transistor T0 is turned on A can be avoided, thereby preventing the light emitting device OLED from emitting light in the compensation stage t1.

In the light emitting stage t2, the third control signal EM outputted by the third control signal terminal is at a low level, so that the fifth transistor T5 and the sixth transistor T6 are turned on. The power voltage Vdd outputted by the power voltage terminal is transmitted to the second node B. The voltage level of the second node B transiently varies from the reference voltage Vsus in the compensation stage t1 to the power voltage Vdd in the light emitting stage t2. Accordingly, the voltage level of the first node A is Vdata-Vth+Vdd-Vsus. At this time, the driving transistor T0 is turned on, and a current flowing through the driving transistor T0 is:

$$I = \frac{1}{2}K(Vsus - Vdata + Vth - Vth0)^2.$$

It is noted that a threshold voltage of the driving transistor T0 is approximately equal to the threshold voltage of the fourth transistor T4 in the pixel compensation circuit provided by the present preferred embodiment. Accordingly, $$I = \frac{1}{2}K(Vsus - Vdata)^2.$$

It can be understood from a calculation result of the above-mentioned function that the current flowing the light emitting device OLED is only relevant to the data voltage Vdata and the reference voltage Vsus. The current is not relevant to the threshold voltage of the driving transistor T0 and the power voltage Vdd which has a voltage drop easily. The pixel compensation circuit not only has a threshold voltage compensation function, but also has a voltage drop compensation function for a power line connected to pixels.

In the pixel compensation circuit in accordance with the present preferred embodiment, the light emitting control module controls the light emitting device to emit light, and the reference voltage writing module compensates for the voltage drop of the power voltage. As such, the pixel compensation circuit can compensate for the threshold voltage and the voltage drop of power voltage and solve the problem that the light emitting device emits light too early, thereby delaying deterioration of the light emitting device and increasing a contrast ration of a display image.

The present disclosure further provides a display device. In the present embodiment, the display device includes the pixel compensation circuit provided by the above-mentioned preferred embodiment. Specific descriptions may be referred to the descriptions of the pixel compensation circuit in accordance with the above-mentioned preferred embodiment and not repeated herein.

In the pixel compensation circuit and the display device in accordance with the present disclosure, the light emitting control module controls the light emitting device to emit light, and the reference voltage writing module compensates for the voltage drop of power voltage. As such, the pixel compensation circuit can compensate for the threshold voltage and the voltage drop of the power voltage and solve the problem that the light emitting device emits light too early, thereby delaying deterioration of the light emitting device and increasing a contrast ration of a display image.

The above description is merely the specific embodiments of the present disclosure, but the protection scope of the present disclosure is not limited thereto, any skilled who is familiar with this art could readily conceive variations or substitutions within the disclosed technical scope disclosed by the present disclosure, and these variations or substitutions shall be encompassed in the protection scope of the present disclosure. Thus, the protection scope of the present disclosure shall be subjected to the protection scope of the claims.

What is claimed is:

1. A pixel compensation circuit, comprising:

a light emitting device, a driving module, a reset module, a reference voltage writing module, a data voltage writing module, a power voltage writing module, and a light emitting control module, wherein a control terminal of the reset module is electrically coupled to a reset signal control terminal, an input terminal of the reset module is electrically coupled to a first node, an output terminal of the reset module is electrically coupled to a ground, and the reset module is configured to reset the first node;

a control terminal of the reference voltage writing module is electrically coupled to a first control signal terminal, an input terminal of the reference voltage writing module is electrically coupled to a reference voltage terminal, an output terminal of the reference voltage writing module is electrically coupled to a second node, and the reference voltage writing module is configured to reset the second node and to write a reference voltage outputted by the reference voltage terminal to the second node;

a control terminal of the data voltage writing module is electrically coupled to a second control signal terminal, an input terminal of the data voltage writing module is electrically coupled to a data voltage terminal, an output terminal of the data voltage writing module is electrically coupled to the first node, and the data voltage writing module is configured to write a difference value between a data voltage outputted by the data voltage terminal and a threshold voltage to the first node;

a control terminal of the power voltage writing module is electrically coupled to a third control signal terminal, an input terminal of the power voltage writing module is electrically coupled to a power voltage terminal, an output terminal of the power voltage writing module is electrically coupled to the second node, and the power voltage writing module is configured to write a power voltage outputted by the power voltage terminal to the second node;

a control terminal of the light emitting control module is electrically coupled to a third control signal terminal, an input terminal of the light emitting control module is electrically coupled to an output of the driving module, an output terminal of the light emitting control module is electrically coupled to an anode of the light emitting device, and the light emitting control module is configured to control the driving module to drive the light emitting device to emit light;

a first terminal of the driving module is electrically coupled to the first node, and a second terminal of the driving module is electrically coupled to the second node;

a cathode of the light emitting device is electrically coupled to the ground;

the driving module comprises a driving transistor and a storage capacitor, wherein a gate of the driving transistor is electrically coupled to the first node, a source of the driving transistor is electrically coupled to the second node, and a drain of the driving transistor is electrically coupled to the input terminal of the light emitting control module;

the storage capacitor is electrically coupled between the first node and the second node;

the reset module comprises a first transistor, wherein a gate of the first transistor is electrically coupled to the reset signal control terminal, a source of the first transistor is electrically coupled to the first node, and a drain of the first transistor is electrically coupled to the ground.

2. The pixel compensation circuit of claim 1, wherein the reference voltage writing module comprises a second transistor, wherein a gate of the second transistor is electrically coupled to the first control signal terminal, a source of the second transistor is electrically coupled to the reference voltage terminal, and a drain of the second transistor is electrically coupled to the second node.

3. The pixel compensation circuit of claim 1, wherein the data voltage writing module comprises a third transistor and a fourth transistor, wherein a gate of the third transistor is electrically coupled to the second control signal terminal, a source of the third transistor is electrically coupled to the data voltage terminal, and a drain of the third transistor is electrically coupled to a source of the fourth transistor;

a gate and a drain of the fourth transistor are electrically coupled to the first node.

4. The pixel compensation circuit of claim 1, wherein the power voltage writing module comprises a fifth transistor, wherein a gate of the fifth transistor is electrically coupled to the third control signal terminal, a source of the fifth transistor is electrically coupled to the power voltage terminal, and a drain of the fifth transistor is electrically coupled to the second node.

5. The pixel compensation circuit of claim 1, wherein the light emitting control module comprises a sixth transistor, wherein a gate of the sixth transistor is electrically coupled to the third control signal terminal, a source of the sixth transistor is electrically coupled to the output terminal of the driving module, and a drain of the sixth transistor is electrically coupled to the anode of the light emitting device.

6. A pixel compensation circuit, comprising:

a light emitting device, a driving module, a reset module, a reference voltage writing module, a data voltage writing module, a power voltage writing module, and a light emitting control module, wherein a control terminal of the reset module is electrically coupled to a reset signal control terminal, an input terminal of the reset module is electrically coupled to a first node, an output terminal of the reset module is electrically coupled to a ground, and the reset module is configured to reset the first node;

a control terminal of the reference voltage writing module is electrically coupled to a first control signal terminal, an input terminal of the reference voltage writing module is electrically coupled to a reference voltage terminal, an output terminal of the reference voltage writing module is electrically coupled to a second node, and the reference voltage writing module is configured to reset the second node and to write a reference voltage outputted by the reference voltage terminal to the second node;

a control terminal of the data voltage writing module is electrically coupled to a second control signal terminal, an input terminal of the data voltage writing module is electrically coupled to a data voltage terminal, an output terminal of the data voltage writing module is electrically coupled to the first node, and the data voltage writing module is configured to write a difference value between a data voltage outputted by the data voltage terminal and a threshold voltage to the first node;

a control terminal of the power voltage writing module is electrically coupled to a third control signal terminal, an input terminal of the power voltage writing module is electrically coupled to a power voltage terminal, an output terminal of the power voltage writing module is electrically coupled to the second node, and the power voltage writing module is configured to write a power voltage outputted by the power voltage terminal to the second node;

a control terminal of the light emitting control module is electrically coupled to a third control signal terminal, an input terminal of the light emitting control module is electrically coupled to an output of the driving module, an output terminal of the light emitting control module is electrically coupled to an anode of the light emitting device, and the light emitting control module is configured to control the driving module to drive the light emitting device to emit light;

a first terminal of the driving module is electrically coupled to the first node, and a second terminal of the driving module is electrically coupled to the second node;

a cathode of the light emitting device is electrically coupled to the ground.

7. The pixel compensation circuit of claim 6, wherein the driving module comprises a driving transistor and a storage capacitor, wherein a gate of the driving transistor is electrically coupled to the first node, a source of the driving transistor is electrically coupled to the second node, and a drain of the driving transistor is electrically coupled to the input terminal of the light emitting control module;

the storage capacitor is electrically coupled between the first node and the second node.

8. The pixel compensation circuit of claim 6, wherein the reset module comprises a first transistor, wherein a gate of the first transistor is electrically coupled to the reset signal control terminal, a source of the first transistor is electrically coupled to the first node, and a drain of the first transistor is electrically coupled to the ground.

9. The pixel compensation circuit of claim 6, wherein the reference voltage writing module comprises a second transistor, wherein a gate of the second transistor is electrically coupled to the first control signal terminal, a source of the second transistor is electrically coupled to the reference voltage terminal, and a drain of the second transistor is electrically coupled to the second node.

10. The pixel compensation circuit of claim 6, wherein the data voltage writing module comprises a third transistor and a fourth transistor, wherein a gate of the third transistor is electrically coupled to the second control signal terminal, a source of the third transistor is electrically coupled to the data voltage terminal, and a drain of the third transistor is electrically coupled to a source of the fourth transistor;

a gate and a drain of the fourth transistor are electrically coupled to the first node.

11. The pixel compensation circuit of claim 6, wherein the power voltage writing module comprises a fifth transistor, wherein a gate of the fifth transistor is electrically coupled to the third control signal terminal, a source of the fifth transistor is electrically coupled to the power voltage terminal, and a drain of the fifth transistor is electrically coupled to the second node.

12. The pixel compensation circuit of claim 6, wherein the light emitting control module comprises a sixth transistor, wherein a gate of the sixth transistor is electrically coupled to the third control signal terminal, a source of the sixth transistor is electrically coupled to the output terminal of the driving module, and a drain of the sixth transistor is electrically coupled to the anode of the light emitting device.

13. A display device, comprising a pixel compensation circuit, the pixel compensation circuit comprising:

a light emitting device, a driving module, a reset module, a reference voltage writing module, a data voltage writing module, a power voltage writing module, and a light emitting control module, wherein a control terminal of the reset module is electrically coupled to a reset signal control terminal, an input terminal of the reset module is electrically coupled to a first node, an output terminal of the reset module is electrically coupled to a ground, and the reset module is configured to reset the first node;

a control terminal of the reference voltage writing module is electrically coupled to a first control signal terminal, an input terminal of the reference voltage writing module is electrically coupled to a reference voltage terminal, an output terminal of the reference voltage writing module is electrically coupled to a second node, and the reference voltage writing module is configured to reset the second node and to write a reference voltage outputted by the reference voltage terminal to the second node;

a control terminal of the data voltage writing module is electrically coupled to a second control signal terminal, an input terminal of the data voltage writing module is electrically coupled to a data voltage terminal, an output terminal of the data voltage writing module is electrically coupled to the first node, and the data voltage writing module is configured to write a difference value between a data voltage outputted by the data voltage terminal and a threshold voltage to the first node;

a control terminal of the power voltage writing module is electrically coupled to a third control signal terminal, an input terminal of the power voltage writing module is electrically coupled to a power voltage terminal, an output terminal of the power voltage writing module is electrically coupled to the second node, and the power voltage writing module is configured to write a power voltage outputted by the power voltage terminal to the second node;

a control terminal of the light emitting control module is electrically coupled to a third control signal terminal, an input terminal of the light emitting control module is electrically coupled to an output of the driving module, an output terminal of the light emitting control module is electrically coupled to an anode of the light emitting device, and the light emitting control module is configured to control the driving module to drive the light emitting device to emit light;

a first terminal of the driving module is electrically coupled to the first node, and a second terminal of the driving module is electrically coupled to the second node;

a cathode of the light emitting device is electrically coupled to the ground.

14. The display device of claim 13, wherein the driving module comprises a driving transistor and a storage capacitor, wherein a gate of the driving transistor is electrically coupled to the first node, a source of the driving transistor is electrically coupled to the second node, and a drain of the driving transistor is electrically coupled to the input terminal of the light emitting control module;

the storage capacitor is electrically coupled between the first node and the second node.

15. The display device of claim 13, wherein the reset module comprises a first transistor, wherein a gate of the first transistor is electrically coupled to the reset signal control terminal, a source of the first transistor is electrically coupled to the first node, and a drain of the first transistor is electrically coupled to the ground.

16. The display device of claim 13, wherein the reference voltage writing module comprises a second transistor, wherein a gate of the second transistor is electrically coupled to the first control signal terminal, a source of the second transistor is electrically coupled to the reference voltage terminal, and a drain of the second transistor is electrically coupled to the second node.

17. The display device of claim 13, wherein the data voltage writing module comprises a third transistor and a fourth transistor, wherein a gate of the third transistor is electrically coupled to the second control signal terminal, a source of the third transistor is electrically coupled to the data voltage terminal, and a drain of the third transistor is electrically coupled to a source of the fourth transistor;

a gate and a drain of the fourth transistor are electrically coupled to the first node.

18. The display device of claim 13, wherein the power voltage writing module comprises a fifth transistor, wherein a gate of the fifth transistor is electrically coupled to the third control signal terminal, a source of the fifth transistor is electrically coupled to the power voltage terminal, and a drain of the fifth transistor is electrically coupled to the second node.

19. The display device of claim 13, wherein the light emitting control module comprises a sixth transistor, wherein a gate of the sixth transistor is electrically coupled to the third control signal terminal, a source of the sixth transistor is electrically coupled to the output terminal of the driving module, and a drain of the sixth transistor is electrically coupled to the anode of the light emitting device.

* * * * *